US005537932A

United States Patent [19]

Jones

[11] Patent Number: 5,537,932

[45] Date of Patent: Jul. 23, 1996

[54] RAILWAY TRUCK BEARING LATERAL THRUST PADS

[76] Inventor: Philip A. Jones, P.O. Box 5368, Boise, Id. 83795

[21] Appl. No.: 398,863

[22] Filed: Mar. 6, 1995

[51] Int. Cl.[6] ..... B61F 5/26

[52] U.S. Cl. ..... 105/224.1; 105/218.1

[58] Field of Search ..... 105/218.1, 171, 105/220, 224.1; 384/158.1, 186, 191.1, 191.4

[56] References Cited

U.S. PATENT DOCUMENTS

| | | | |
|---|---|---|---|
| 2,267,466 | 12/1941 | Janeway | 105/224.1 |
| 2,335,120 | 11/1943 | Janeway et al. | 105/224.1 |
| 4,433,629 | 2/1984 | Roush | 105/224.1 |
| 4,510,871 | 4/1985 | Habeck et al. | 105/171 |
| 4,679,506 | 7/1987 | Goding et al. | 105/218.1 |
| 4,765,250 | 8/1988 | Goding | 105/172 |
| 4,932,230 | 6/1990 | Herring | 105/224.1 |

*Primary Examiner*—Robert J. Oberleitner
*Assistant Examiner*—S. Joseph Morano
*Attorney, Agent, or Firm*—Frank J. Dykas

[57] ABSTRACT

Lateral thrust pads mounted to stop members projecting from bearing housings of a railway truck opposite respective pedestals of the truck frame under constant, compressive, slidable contact with such pedestals to absorb lateral thrust loads upon relative movement between the bearing housings and the truck frame. Because each thrust pad is in constant compressive contact with the opposite stop member, there is no unrestricted lateral movement with attendant increased potential for hunting. The thrust pad comprises an elastomer pad having a stiffness constant which varies in proportion to the amount the pad is compressed, thus providing for absorption of higher lateral thrust loads, while at the same time permitting nominal self-centering and curve negotiation lateral motions of the axle.

9 Claims, 5 Drawing Sheets

RAILWAY TRUCK BEARING LATERAL THRUST PADS

BACKGROUND OF THE INVENTION

1. Technical Field

This invention relates to railway vehicles and trucks therefor. More particularly, this invention relates to a means for absorbing lateral loads between a bearing supported axle and a rail vehicle truck.

2. Background

Conventional railway truck designs comprising a pair of laterally-spaced side frames, at least one transom, and a plurality of axle and wheel sets extending transversely there between have become the standard in many railway industry applications. Problems encountered with these conventional rail trucks include the tendency for the wheel sets to traverse curves in a non-radial orientation and with much wheel flange to rail rubbing contact. Furthermore, the wheel sets may tend to slide during negotiation of track curves. Such rubbing contact and wheel sliding result in undesirably high wheel and rail wear, and the flange rubbing in particular may produce a tendency for the wheel to climb the rail. Improper wheel set tracking in curves may also result in truck misalignment.

Additionally, curved and imperfect track and imperfect wheels impose lateral forces on the wheel sets, tending to displace them laterally off the truck's centerline. When a rail vehicle truck having a number of axles held parallel or in fixed relation to one another passes through a curve, the truck experiences "basic" lateral loading forces, known as curve negotiation forces, which are related to the frictional forces between the rails and wheels. These forces result from the fact that all wheels of the truck cannot line up tangent to the rails, especially with multiple axle trucks.

In addition to the "basic" lateral forces which occur even with theoretically perfect wheel and rail interaction, other dynamic lateral forces occur as a result of the inevitable imperfections and wear in the rail and wheels, and the wheels passing through switches and crossovers. These lateral forces are transmitted through the axle to the bearing and bearing housing supporting the axle on the truck, resulting in increased wear of the bearings and other truck components.

Other related problems occur when conventional trucks traverse straight, or tangent, runs of track. For example, a rigid wheel axis set, having conventional tapered conical wheels, when displaced laterally from the centerline of a run of straight track, executes two simultaneous motions; first, the wheel set moves toward the equilibrium (center) position under the influence of gravity, and secondly, the high side wheel, rolling on a larger diameter than the low side wheel, moves along the rail faster than its partner, causing the wheel set to yaw. Given the proper set of circumstances, this motion may become a sustained, harmonic oscillation known as hunting. The hunting tendency is transmitted to the truck and causes an oscillatory yawing motion of the truck about its center of rotation, resulting in additionally high truck component wheel and rail wear.

The problems associated with wheel sets traversing curves in a non-radial orientation have been recognized in the prior art and a variety of self-steering railway truck designs have been devised which purport to allow wheel sets to track without sliding and without undue flange rubbing during negotiation of curves, and with minimal adverse consequences resulting from hunting. These designs typically interconnect diagonally opposite wheels on the end axles of a truck so that an opposite rotation, or yaw, of one truck axle is induced in response to the yawing of another truck axle when the truck is encountering a curve. Such a self-steering railway truck design is shown in the patent to Goding, U.S. Pat. No. 4,765,250.

The axles of a rail vehicle truck are rotatably supported parallel to one another in the truck frame by bearing assemblies which are mounted to the truck frame generally within bearing housings which fit between members of the truck frame known as pedestals. Relative, generally longitudinal motion between the bearing housing and respective pedestals is necessary in order to permit the axles to yaw pursuant to the self-steering action of the truck. Furthermore, the pedestals must be free to slide vertically up and down relative to their respective bearing housing to permit frame mounted cushioning springs to absorb shock that would otherwise be transmitted from the wheel sets through the bearings to the truck frame.

The problems associated with lateral thrust loads and lateral displacement of the wheel sets in relation to the frame members during negotiation of curves have been addressed in a variety of ways. For example, it is known to provide rubber cushioning members internal to a bearing housing, as in Janeway, U.S. Pat. Nos. 2,267,466 and 2,335,120. Rousch, Jr., U.S. Pat. No. 4,433,629, teaches another solution, with bearing housings which include thereon a lateral thrust absorption pad which is compressed between the bearing housings and the truck frame. The thrust pad acts in compression to absorb the lateral thrust loads and may be easily removed and replaced, since it is entirely external. Each bearing housing includes a pair of stop members thereon which confront the inside of the frame pedestals and are laterally spaced there from by a predetermined amount. Each stop member has mounted thereto a lateral thrust load absorption pad comprised of an elastomer pad bonded to a hardened wear plate. The predetermined clearance between the stop member and the pedestals of the truck frame is sufficient to allow a given amount of unrestricted lateral movement and to allow the elastomer pad to be compressed to absorb the lateral thrust load. Though some lateral movement of the axle and wheel sets relative to the truck frame is necessary to allow the rail truck to properly negotiate a curve, "unrestricted lateral movement" is undesirable due to the increased potential for hunting.

It is therefore an object of the invention to absorb lateral thrust loads between the bearing housings and frame of a rail truck, while at the same time allowing sufficient freedom of lateral movement to permit smooth negotiation of curved track sections.

It is a further object of the present invention to absorb lateral thrust loads between the bearing housings and frame of a rail truck, while at the same time minimizing hunting.

Yet another object of the present invention is to absorb lateral thrust loads between the bearing housings and frame of a rail truck, while at the same time permitting vertical and longitudinal movements of the bearing housings relative to the frame.

DISCLOSURE OF INVENTION

These and other objects are accomplished by improved lateral thrust pads mounted on stop members extending from the axle bearing housing for absorbing lateral thrust loads transmitted from the axles to the bearing housings to the frame, while at the same time minimizing hunting. The invention comprises resilient elastomer pads mounted on the bearing housing stop members in confronting relation and constant, compressive slidable contact with a stop member on a truck frame. Because the pads are in constant, compressive contact with the frame stop members, there is no unrestricted lateral movement and hunting is inhibited. At the same time, because the pads are slidably and not fixedly attached to the frame stop members, vertical and longitudinal movements of the bearing housings relative to the truck frame are not unduly inhibited to the detriment of vertical shock absorption or truck self-alignment motions.

Furthermore, the elastomer thrust pads of the invention are designed to have stiffness constants which vary in proportion to the amount of lateral compression of the pad. In the preferred embodiment, the elastomer pads have two stiffness constants, $K_1$ and $K_2$. At smaller lateral displacements of the bearing housings relative to the truck frame, an initial stiffness constant $K_1$ provides nominal resistance to lateral motion. This allows some axle self centering action to occur, but does not allow unrestricted lateral motion to encourage the onset of hunting. At lateral displacement of the bearing housing beyond a certain point, the thrust pad will be compressed sufficiently to present stiffness constant $K_2$, which presents an increased resistance to lateral compression. Higher lateral thrust loads are thus absorbed while at the same time minimizing hunting.

In the first embodiment of the invention, the lateral thrust pads are comprised of elastomeric material bolted directly to the bearing housing stop member. In a second embodiment of the invention, the thrust pads are comprised of the elastomeric pad bonded between a mounting plate and an outer hardened contactor wear plate. The mounting plate and the hardened wear plate may be made of metal or other suitable material. The mounting plate permits more secure mounting to the stop member, while the hardened wear plate increases the life of the thrust pad.

These and other features and advantages of the invention will be more fully understood in the following description of the preferred embodiment of the invention, taken together with the accompanying drawings.

BEST MODE FOR CARRYING OUT INVENTION

Figure 1:
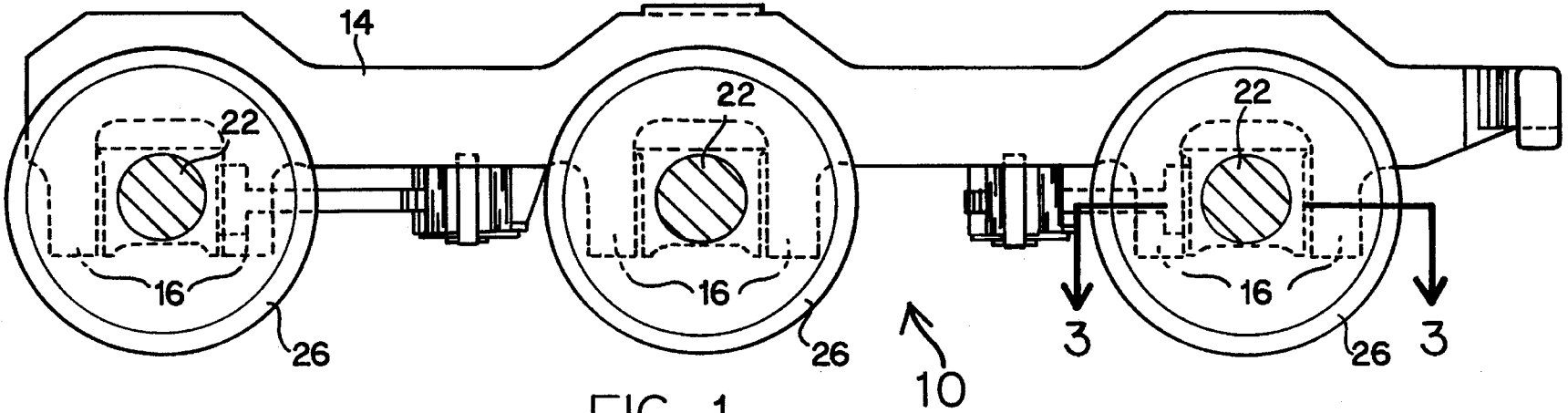
FIG. 1 is a side representational view of a conventional three axle railway truck.
Figure 2:
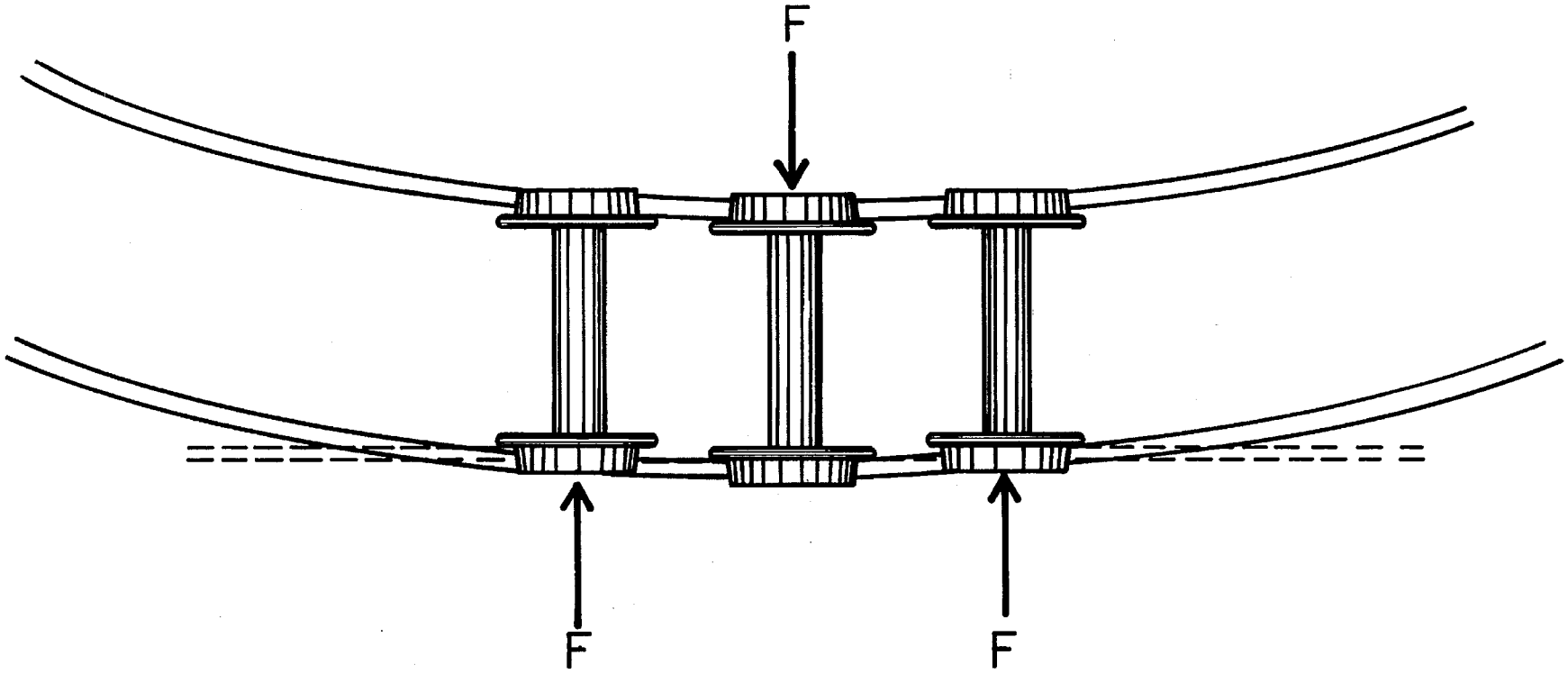
FIG. 2 is a plan view schematic representation of a conventional three axle railway truck negotiating a curved track, showing lateral displacement of the axles with lateral forces on the truck indicated by the letter "F".

Referring first to FIG. 1, a railway locomotive or power transit truck 10 generally includes a conventional truck frame 14 having pedestals 16. Three axles 22 in parallel rotatably support the frame 14 thereon. Each axle includes a pair of wheels 26. As rail truck 10 negotiates curved rails, wheels 26 on parallel axles 22 cannot line up all at once tangent to the curved rails, and the frictional curve negotiation forces thereby induced in wheels 26 will cause axles 22 to move laterally with respect to the truck frame 14. This lateral movement induces lateral thrust loads, as shown in FIG. 2, which it is desirable to cushion and absorb, in addition to the dynamic loads.

Figure 3:
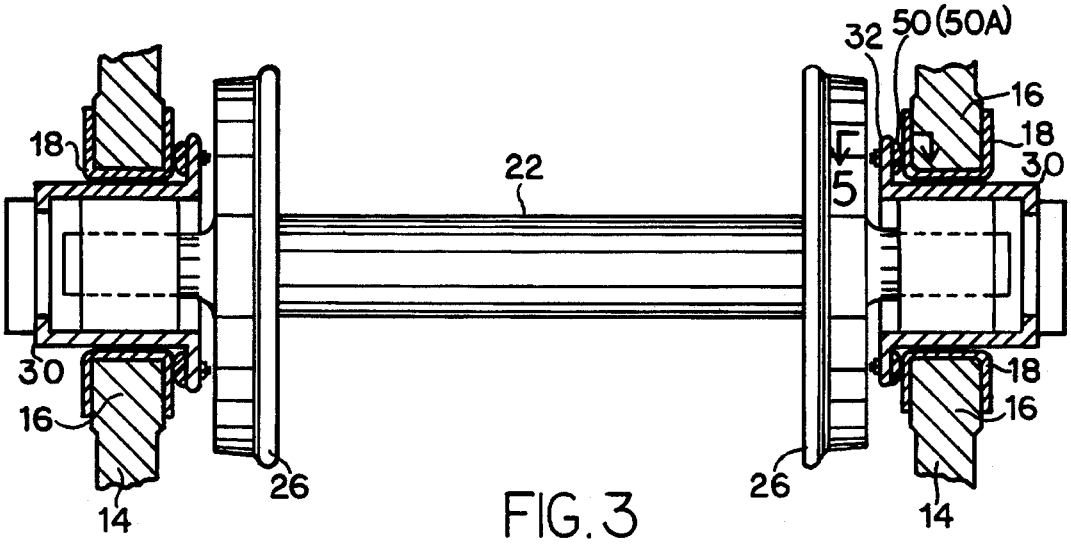
FIG. 3 is a cross sectional view along the line 3—3 of FIG. 1, showing an axle slidably mounted to the truck frame and showing two bearing housings in cross-section.

Referring now to FIG. 3, details of the mounting of an axle 22 to truck frame 14 may be seen. Truck frame 14 includes six spaced pairs of pedestals 16, two pairs for each axle 22. A bearing housing 30 is mounted to the end of each axle 22. Each bearing housing 30 is slidably fitted between pedestals 16 with a conventional wear liner 18 mounted there between. As wheels 26 are moved laterally by the rails during curve negotiation, each axle 22 moves laterally, taking its bearing housing 30 with it.

Figure 9:
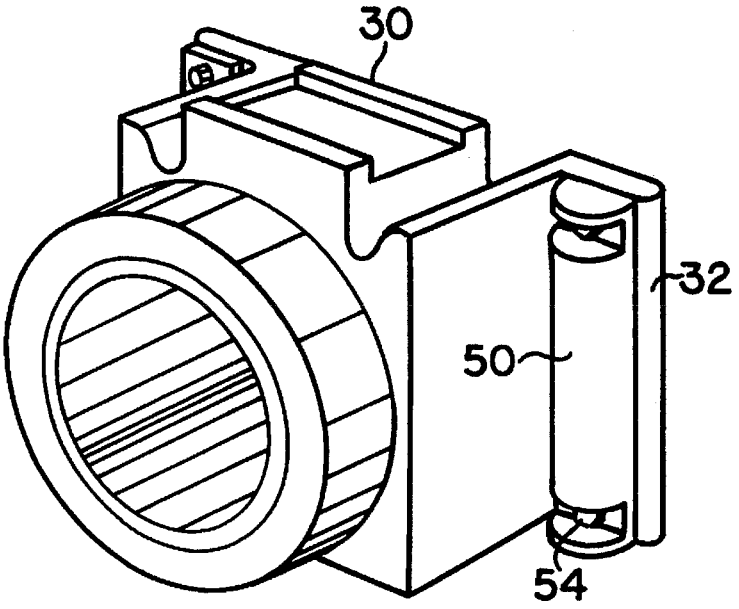
FIG. 9 is a perspective view of a bearing housing and first embodiment thrust pad mounted thereto.
Figure 10:
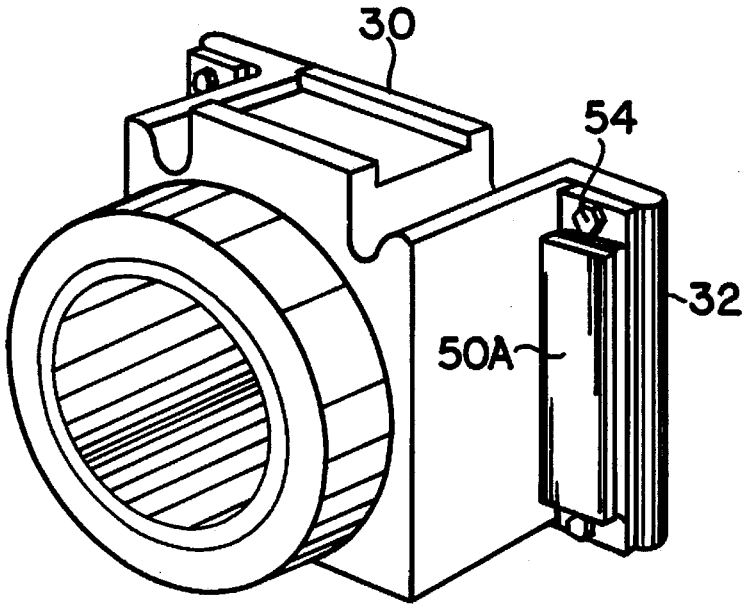
FIG. 10 is a perspective view of a bearing housing and a second embodiment thrust pad mounted thereto.

Referring additionally to FIGS. 9 and 10, to limit the lateral movement of the bearing housings 30, each bearing housing includes thereon a pair of stop members 32, which are cast as integral ears to bearing housings 30, although they could be attached thereto by any means of sufficient rigidity. Each stop member 32, in a position opposite its respective wear liner 18 on pedestal 16, is provided with a thrust pad 50 or 50A bolted thereto. Thrust pads 50 or 50A are sized so that there is no clearance between the pad and its respective wear liner 18, even when its respective axle 22 is centered on the truck frame with no lateral displacement.

Figure 4:
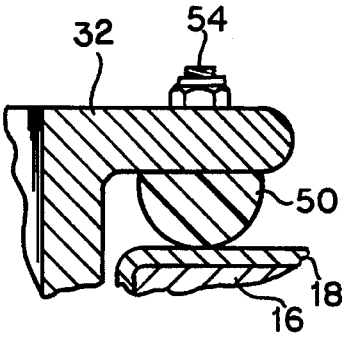
FIG. 4 is an enlarged view of a portion of FIG. 3 showing the first embodiment thrust pad.
Figure 5:
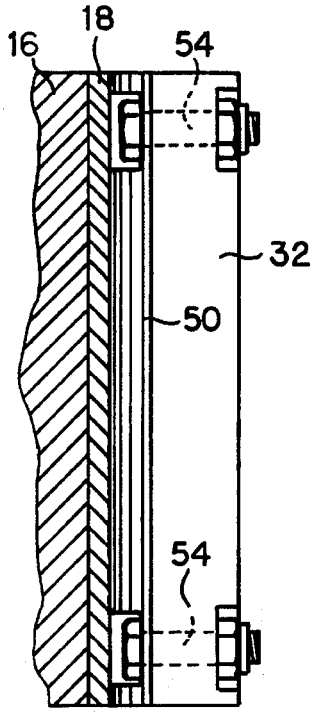
FIG. 5 is a view along the line 5—5 of FIG. 3 showing the first embodiment thrust pad mounted to a stop member.
Figure 6:
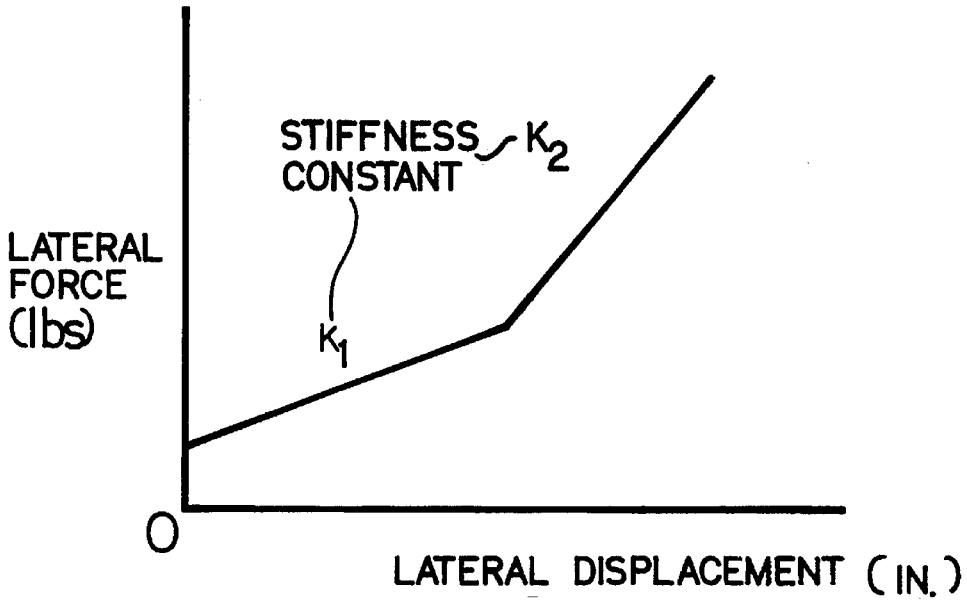
FIG. 6 is a graph showing the lateral force exerted by the thrust pad as a function of the lateral displacement of the bearing housing stop member relative to the frame stop member, and demonstrating the two stiffness constants of the thrust pad.

Referring now to FIGS. 4 and 5, the details of a first embodiment of thrust pad 50 and its mounting to stop member 32 may be seen. Each first embodiment thrust pad 50 is formed of polyurethane or other suitable material and attached to its respective stop member 32 by means of bolts 54. Each thrust pad 50 presents a convex, curved surface at its contact with wear liner 18, said convex curved surface being curved about an axis generally perpendicular to the transverse axis, thus facilitating axle angulation during curved track or self-steering action. Because each thrust pad 50 is in constant compressive contact with its respective wear liner 18, there is no space for unrestricted lateral travel and hunting is thereby minimized. Furthermore, in the preferred embodiment, each thrust pad 50 is designed to have a higher stiffness K after it has been compressed beyond a given point, as shown in FIG. 6. Thus, thrust pads 50 allow some low force lateral movement of the axles 22 over a limited range to permit some centering and curve negotiation movements, while at the same time present a higher stiffness to inhibit to a greater extent further lateral movement at higher compression to absorb higher lateral thrust loads. Thrust pads 50 thus always provide some resistance to lateral motions to minimize hunting.

Figure 7:
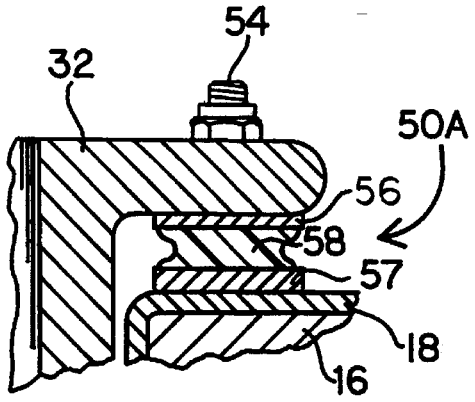
FIG. 7 is an enlarged view of a portion of FIG. 3 showing the second embodiment thrust pad.
Figure 8:
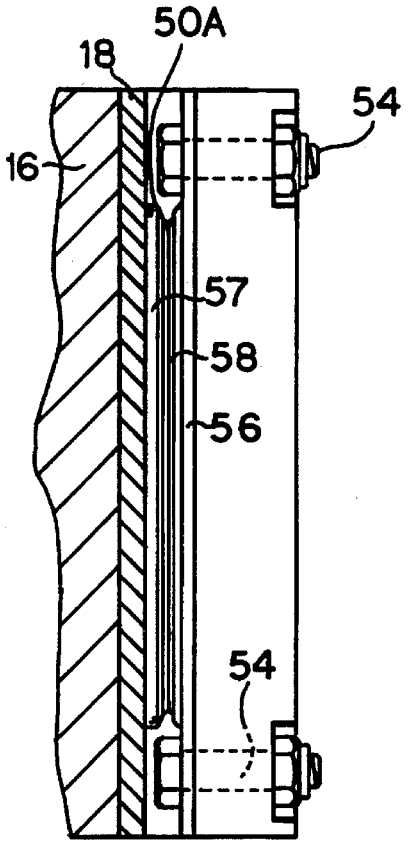
FIG. 8 is a view along the line 5—5 of FIG. 3 showing the second embodiment thrust pad mounted to a stop member.

Referring now to FIGS. 7 and 8, the details of a second embodiment thrust pad 50A and its mounting to stop member 32 may be seen. Each thrust pad 50A includes a mounting plate 56, a hardened contactor wear plate 57, and an elastomer pad 58, bonded therebetween creating an integral unit. Mounting plate 56, which permits more secure mounting of the thrust pad to stop member 32, is made of metal or other suitable material and is bolted to stop member 32 using mounting bolts 54. Hardened wear plate 57, which increases the useful life of the thrust pad, is also formed of metal or other suitable material. Elastomer pad 58 is formed of polyurethane, natural rubber or other suitable material. In the embodiment disclosed, pad 58 is formed of polyurethane that has a stiffness constant which increases when the pad is compressed beyond a certain point.

The operation of thrust pads 50 may be understood by referring to FIGS. 3, 4, 6 and 9. As the rail truck 10 rounds a curve, one bearing housing 30 and its respective one stop member 32 at one end of one axle 22 will move laterally outward with respect to truck frame 14, while the other bearing housing 30 and its respective other stop member 32 at the other end of the axle 22 will move laterally inward with respect to the truck frame. The polyurethane thrust pad 50 of the one stop members 32 will be further compressed between the one stop members 32 and their respective wear liners 18 on pedestal 16. Thrust pad 50 will initially provide a nominal resistance to lateral motion, based on its initial stiffness constant $K_1$, as shown in FIG. 6. As bearing housing 30 is displaced further laterally, further compressing thrust pad 50 beyond a certain point, thrust pad 50 will present increased resistance to compression, based on its secondary stiffness constant, $K_2$, as shown in FIG. 6, to absorb the lateral thrust load and at the same time minimize hunting.

The operation of thrust pads 50A may be understood by referring to FIGS. 3, 6, 7, 8 and 10. As rail truck 10 rounds a curve, one bearing housing 30 and its respective one stop members 32 will move laterally outward with respect to truck frame 14, while the other bearing housing 30 of that same axle 22 and its respective other stop members 32 will move laterally inwardly with respect to the truck frame. The hardened wear plates 57 of the one stop members 32 will be forced into stronger contact with their respective wear liners 18, compressing the elastomer pads 58 between their respective mounting plates 56 and wear plates 57. Initially, elastomer pad 58 will present nominal resistance to compression based on stiffness constant $K_1$. As shown in FIG. 6, however, as elastomer pad 58 is compressed beyond a predetermined point, its stiffness constant will increase to a higher value, $K_2$, as shown in FIG. 6, providing greater resistance to lateral movement and absorbing the lateral thrust loads, while at the same time minimizing hunting.

Because elastomer thrust pads 50 and 50A are in constant compressive contact with their respective wear liners 18, no uncontrolled or undamped lateral motion of bearing housings 30 and the axle and wheel sets relative to the truck frame can occur, thereby minimizing hunting. Furthermore, the dual stiffness property of elastomer pads 50 and 50A permit limited lateral motion of the axle and wheel sets with limited resistance in opposition thereto, thus permitting minor centering adjustments of the wheel set and limited self steering motions. At the same time, however, at larger lateral displacements, the elastomer pads 50 and 50A present higher resistance for absorbing the lateral thrust loads.

In both embodiments of the invention, because thrust pads 50 and 50A are in slidable and not fixed contact with wear liners 18, vertical and longitudinal motions of bearing housing 30 relative to frame 14 may occur to permit vertical thrust load absorption and truck self-alignment motions.

A modification of the structure disclosed may be made without affecting the operation of the invention. If desired, thrust pads 50 or 50A could be mounted to a portion of truck frame 14 itself, such as pedestal 16 and confront and be compressed against the stop members 32 or some other portion of bearing housing 30. Such an arrangement provides similar lateral thrust absorption and hunting minimization advantages.

Thus, the subject invention provides a lateral thrust absorption means for a rail truck which permits some wheel set centering and self steering motions, while at the same time minimizing hunting.

While the invention has been described by reference to certain preferred embodiments, it should be understood that numerous changes could be made within the sphere and scope of the inventive concepts described. For example, though the above description refers to a three-axle truck, because the invention works on an individual axle and wheel set, the invention may be beneficially applied to railway trucks having various numbers of axles. Accordingly, it is intended that the invention not be limited to the disclosed embodiment, but that it have the full scope permitted by the language of the following claims.

I claim:

1. In a railway truck for use with a railway locomotive or powered transit car, said railway truck including a truck frame and at least one wheel and axle assembly having a pair of opposing wheels interconnected by an axle, defining a transverse axis, the truck frame rotatably supported on the axles by bearings contained within bearing housings, one bearing housing provided at each end of each axle, the bearing housings freely slidably mounted to the truck frame, each bearing housing including a pair of stop members in confronting relation to respective stop members on the truck frame and laterally spaced therefrom by a predetermined amount, the stop members of the bearing housing at one end of one axle moving laterally toward the respective stop members of the truck frame as that axle and both its bearing housings move as a unit laterally in one direction, the stop members of the bearing housing at the other end of that axle moving laterally toward the respective stop members of the truck frame as that axle and both its bearing housings move as a unit laterally in the other direction, lateral thrust load absorption means associated with each bearing housing for absorbing lateral thrust loads between the bearing housings and the truck frame, comprising a pad having first and second surfaces, the pad mounted to each stop member associated with each bearing housing at the first surface of the pad and in confronting relation and constant compressive slidable contact with the other respective stop member on the truck frame at the second surface of the pad, with lateral movement of an axle and its associated bearing housings as a unit in one direction compressing the pad between the respective stop members of one bearing housing and truck frame to absorb the lateral thrust load, and with lateral movement of the bearing housings and axle as a unit in the other direction compressing the pad between the respective stop members of the other bearing housing of that axle and the truck frame to absorb the lateral thrust load, thereby preventing uncushioned contact between bearing housing and truck frame due to the lateral movement of the bearing housings and axles in either direction.

2. The lateral thrust load absorption means of claim 1 wherein each pad further includes a mounting plate forming the first surface of the pad, and a hardened wear plate forming the second surface of the pad, and an elastomer member bonded therebetween.

3. The lateral thrust load absorption means of claim 2 wherein the elastomer member has a stiffness constant which varies in proportion to the amount of compression.

4. The lateral thrust load absorption means of claim 2, wherein the elastomer pad has two stiffness constants.

5. The lateral thrust load absorption means of claim 1 wherein the second surface of each pad is generally convex, curved about an axis generally perpendicular to the transverse axis.

6. The lateral thrust load absorption means of claim 1, wherein each pad comprises an elastomer member made of polyurethane.

7. The lateral thrust load absorption means of claim 6 wherein the elastomer member has a stiffness constant which varies in proportion to the amount of compression.

8. The lateral thrust load absorption means of claim 1, wherein each pad comprises an elastomer member made of natural rubber.

9. The lateral thrust load absorption means of claim 8, wherein the elastomer member has two stiffness constants.

* * * * *